United States Patent [19]

Wercholoz

[11] Patent Number: 4,634,133

[45] Date of Patent: Jan. 6, 1987

[54] ROADWAY EXPANSION JOINT WITH IMPROVED SEAL SECURING ASSEMBLY

[75] Inventor: Robert J. Wercholoz, Burlington, Canada

[73] Assignee: Wercholoz-Honel Systems Inc., Burlington, Canada

[21] Appl. No.: 722,824

[22] Filed: Apr. 12, 1985

Related U.S. Application Data

[63] Continuation of Ser. No. 506,328, Jun. 21, 1983, abandoned.

[51] Int. Cl.[4] ..... F16J 15/12; E01C 11/10

[52] U.S. Cl. ..... 277/12; 277/166; 404/69

[58] Field of Search ..... 277/166, 12, 32, 212 FB; 404/49, 64, 66, 68, 69

[56] References Cited

U.S. PATENT DOCUMENTS

| | | | |
|---|---|---|---|
| 3,527,009 | 9/1970 | Nyquist | 404/69 X |
| 3,570,378 | 3/1971 | Honegger | 404/69 |
| 3,606,826 | 9/1971 | Bowman | 404/69 X |
| 3,887,292 | 6/1975 | Koster | 404/69 |
| 4,111,584 | 9/1978 | Fyfe | 404/69 |
| 4,221,502 | 9/1980 | Tanikawa | 404/68 X |
| 4,295,315 | 10/1981 | Lynn-Jones et al. | 404/69 X |

FOREIGN PATENT DOCUMENTS

| | | | |
|---|---|---|---|
| 241514 | 7/1965 | Austria | 404/68 |
| 2305228 | 8/1974 | Fed. Rep. of Germany | 404/69 |
| 630978 | 7/1982 | Switzerland | 404/68 |
| 896034 | 5/1962 | United Kingdom | 404/64 |

*Primary Examiner*—Robert S. Ward

*Attorney, Agent, or Firm*—Burgess, Ryan & Wayne

[57] ABSTRACT

An expansion joint which provides a flexible seal between two spaced-apart confronting sections of similar structures such as roadway slabs or the like. The expansion joint includes at least one assembly adapted to be secured to each section of the structure. The assembly has an upper elongated beam portion and a lower elongate and fixed forming bar portion. The beam portion and the bar portion are spaced apart to provide an elongated channel. The channel defines has a mouth which opens towards the gap between opposing assemblies. The joint includes a sealing element for spanning the gap between the assemblies. The sealing element includes a flexible intermediate portion with two laterally extending elongate flanks. At least one clamp member lockingly engages the flanks to each of the confronting sections. The clamp member, together with the flanks, are insertable into a channel defined by the upper beams and lower forming bar. The clamp member is secured between upper beam and lower forming bar and the clamp and the flank are secured together by compressive engagement between the clamps and the flanks.

3 Claims, 11 Drawing Figures

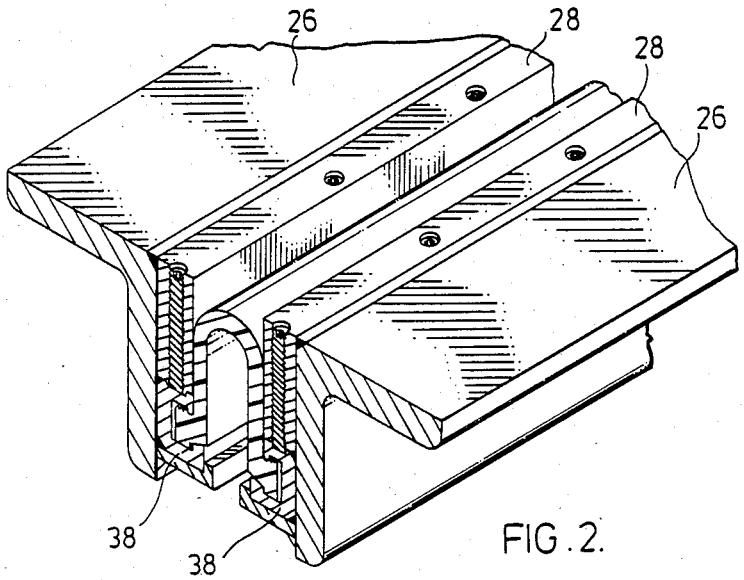
FIG. 2.
FIG. 3.
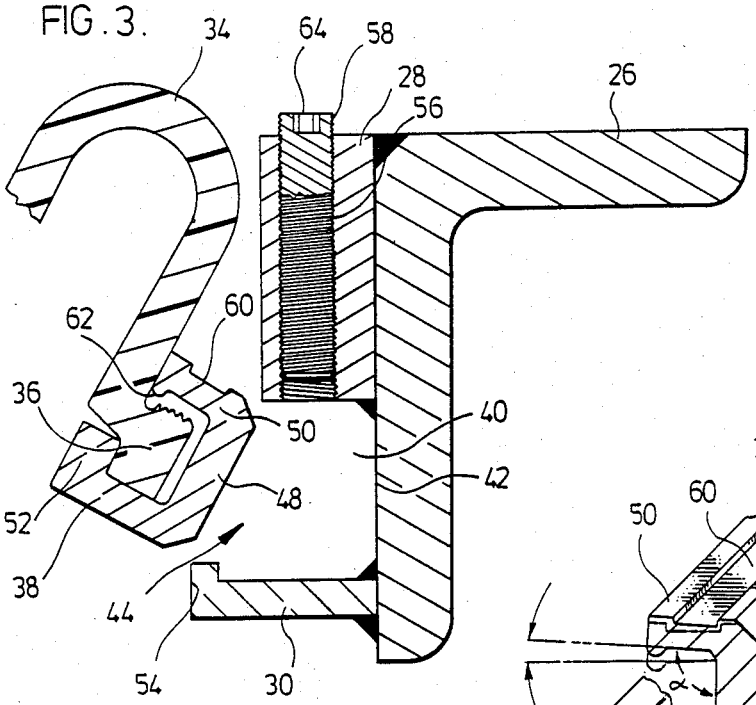
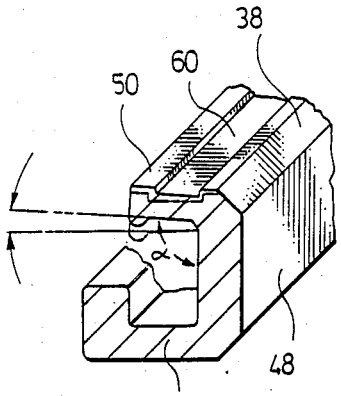
FIG. 4.

ROADWAY EXPANSION JOINT WITH IMPROVED SEAL SECURING ASSEMBLY

This application is a continuation of application Ser. No. 506,328, filed on June 21, 1983, now abandoned.

The present invention relates to an expansion joint providing a flexible seal between two spaced-apart and confronting sections of similar structures. In particular, the present invention relates to a roadway expansion joint.

Expansion joints are commonly used between large structures such as road-beds and bridges for highways to provide a seal between adjacent concrete slabs. The seal is a flexible seal of elastic material which will accommodate relative movement of the slabs brought about by expansion or contraction of the slabs due to temperature fluctuations. The seal is provided between the structures to prevent water, dirt and other debris finding their way between the slabs.

One expansion joint currently in use is that described in U.S. Pat. No. 3,570,378 issued Mar. 16, 1971 to Honegger. This patent discloses a roadway expansion joint having an assembly which is securable to each of the confronting concrete slabs. The assembly includes an upper portion and a lower locking bar or plate. A bolt passing through a threaded aperture in the upper portion threadably engages the locking plate whereby the locking plate may be drawn up towards the upper portion. As the locking plate is drawn up, the flank of the sealing element is sandwiched between the upper portion and the locking plate. In another embodiment disclosed in this patent, the upper portion is movable relative to the lower locking plate by means of a bolt passing through the upper portion and lower locking plate. In practice, to reduce the amount of steel used in the disclosed assemblies, the steel forming angle terminates just below the lower locking plate. In order to prevent concrete from coming up and engaging the lower locking plate, an additional forming bar or plate is employed. Concrete should not engage the locking plate because the concrete may prevent travel of the locking plate or inhibit rotation of the locking bolt.

A disadvantage with the above-mentioned joint is that two plates, the lower forming plate and the lower clamping plate are required which adds steel and thus material cost to the joint. Another disadvantage with the above-mentioned joint is that the bolt passes through both the upper portion and lower clamping plate. As a result, the sealing element is sealed between the upper portion and the lower locking plate inwardly of the bolts. To accomplish this, more steel is required than to merely engage the flank adding to the material cost of the joint. A further disadvantage of this joint is that the lower locking plate is spaced apart from the forming angle. As a result, it may be possible in certain conditions for water to leak in between the seal and the upper portion around the bolt and down the gap between the lower locking plate and forming angle. This water seepage defeats the purpose of the joint and may cause the threads of the bolt to rust, making replacement of the seal difficult. Lastly, during installation of the seal at the job site the bolts must be driven down such that the lower locking plate is dropped allowing sufficient space for the flank of the seal to be inserted into the space between the upper portion and the lower locking plate. The problem here is that a great number of bolts may have to be slackened off to drop the locking plate adding labour cost to the installation. The cost of manufacturing this joint is also increased due to the drilling, boring and tapping required in the upper portion.

It is therefore an object of the present invention to provide an expansion joint which is readily installed on site economizing on labour costs.

It is another object of the present invention to provide an expansion joint wherein the amount of steel in the structure is reduced, reducing overall costs of the structure.

In accordance with an aspect of the present invention there is provided an expansion joint adapted to provide a flexible seal between two spaced-apart and confronting sections of similar structures such as roadway slabs or the like. The joint includes at least one seal support assembly adapted to be secured to each of the confronting sections to define a gap between opposing seal support assemblies when secured to the confronting sections. The assembly includes an upper elongate portion and a lower elongate forming portion both located adjacent the gap. The upper portion and lower portion are fixedly spaced apart to provide an elongate channel therebetween. The channel has its mouth opening toward the gap. The upper portion and the lower portion each include respective seal locking means. The joint includes a sealing means for spanning the gap between the opposing sections. The sealing means includes a flexible intermediate portion and two laterally extending elongate flanks. The expansion joint further includes at least one clamp means adapted for locking engagement to each of the flanks and the assemblies. The clamp means, together with the flanks, are insertable into the channel so that when the clamp means are compressed the flank and clamp are secured in the channel.

Because the clamp means and flank are compressed into engagement there is no need to pass bolts down through the fastening assembly. As a result, the widths of the upper portion and lower forming portion are reduced. The reduced width of these members reduces the material cost of the assembly. Also, because the lower forming portion is fixed and bolts are not required to pass through the forming portion, the forming portion serves the dual purpose of a forming plate and locking plate eliminating the need for two separate plates and thereby reducing the material cost of the joint. Further, it is not necessary to drill and tap a hole in the lower forming bar or plate. This reduces the labour manufacturing cost of the joint.

While in some embodiments of the invention water may seep between the upper portions of the clamp means and top wall of the slot, because the lower forming portion is secured to the assembly, water must continue to find its way between the slot walls and the clamping member or flank. This continued travel of water is unlikely. Clearly, this feature finds advantage over the prior art where the locking bar is spaced from the assembly.

Another advantage of the expansion joint of the present invention is that no adjustment of the slot size is necessary prior to insertion of the clamp means and seal flank into the slot. As a result, the site time required to install the joint is reduced, reducing the labour cost of installation.

In one embodiment of the present invention, the clamp means comprises an elongate compressible member having a major portion positioned on the upper surface of the flank. The seal locking means of the upper portion includes, in this embodiment, at least one threaded aperture and corresponding bolt threadably engaging the aperture. The bolt is accessable from above the joint. The bolt is rotated to engage the clamp and to compress the clamp and flank against the lower forming portion. In another preferred embodiment of the present invention, the clamping means comprises an elongate compressible clamping member having a rear wall and normally diverging upper and lower jaws which embrace the flank when the flank and clamping member are inserted into said slot. When the upper jaw of the clamping member is urged into engaement with the flank the flank and the clamp are restrained from movement.

For a better understanding of the nature and objects of the present invention, reference may be had by way of example to the accompanying diagrammatic drawings in which:

FIG. 2 is a perspective view of the first embodiment of the expansion joint of the present invention;

FIG. 3 is a partial sectional view showing installation of the seal and clamp member of the first embodiment of the present invention;

FIG. 4 is a perspective view showing one embodiment of the clamping member of the present invention;

Figure 9:
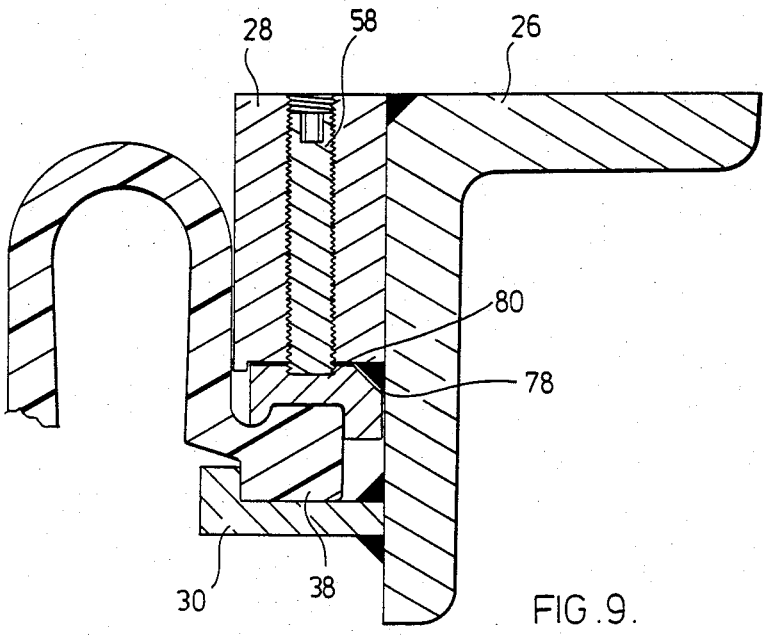
Figure 10:
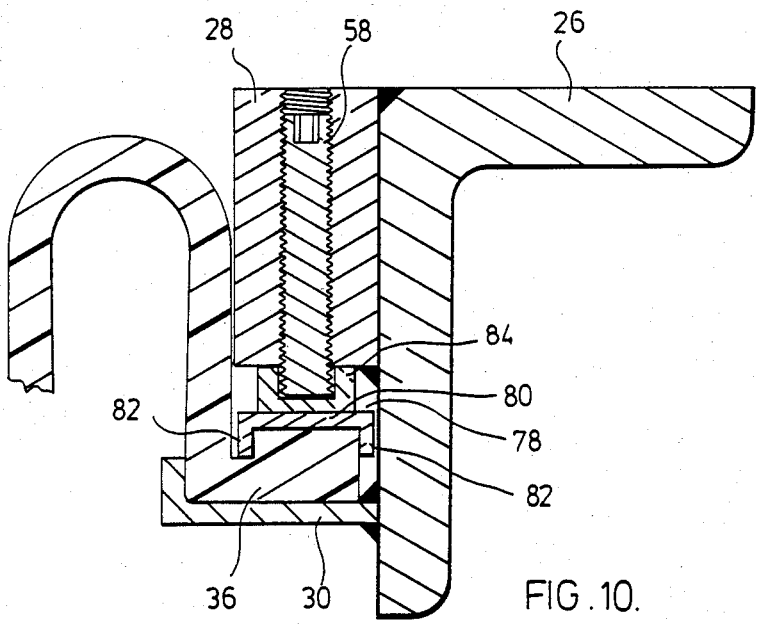
Figure 11:
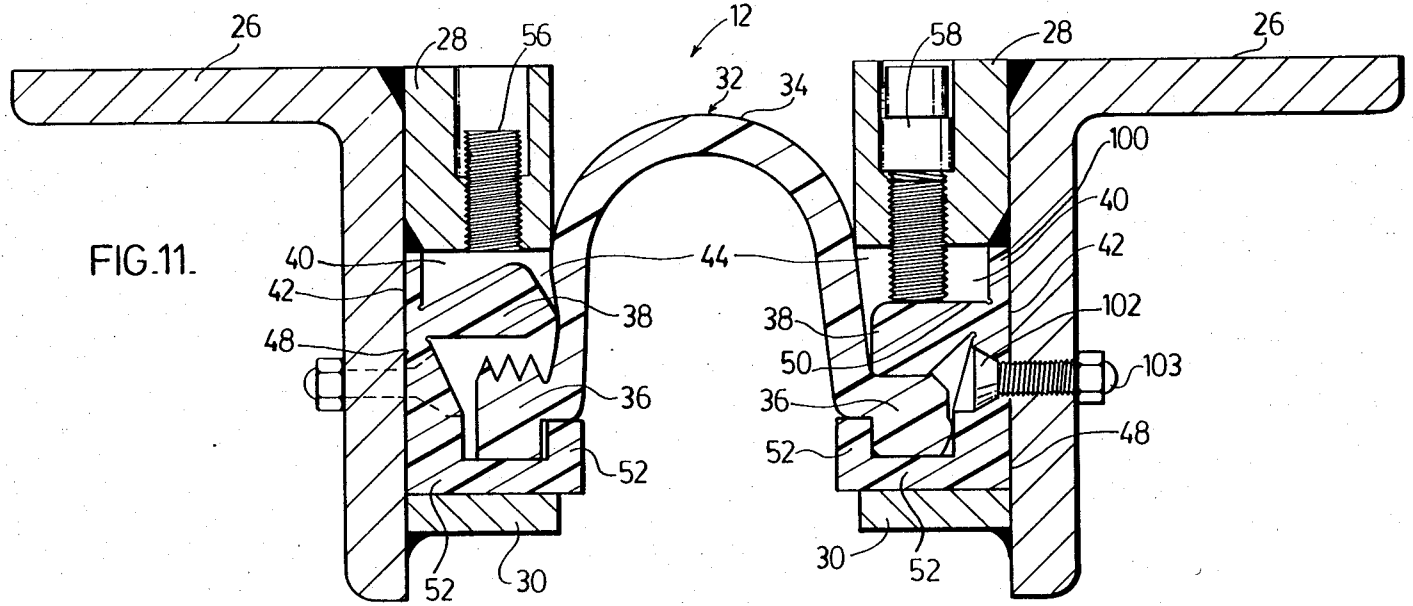

FIGS. 5 through 10 inclusive are partial side sectional views showing other embodiments of the joint of the present invention; and FIG. 11 is a schematic section through a further alternative embodiment of a seal in which the left side is one section shown in an unsecured relationship and the right side is another section illustrated in a secured relationship.

Referring now to FIGS. 1 through 4, there is shown an expansion joint 10 which provides a flexible seal between two spaced-apart and confronting roadway slab sections 14. The section 14 is a concrete slab having a bituminous roadway surface 16.

Figure 1:
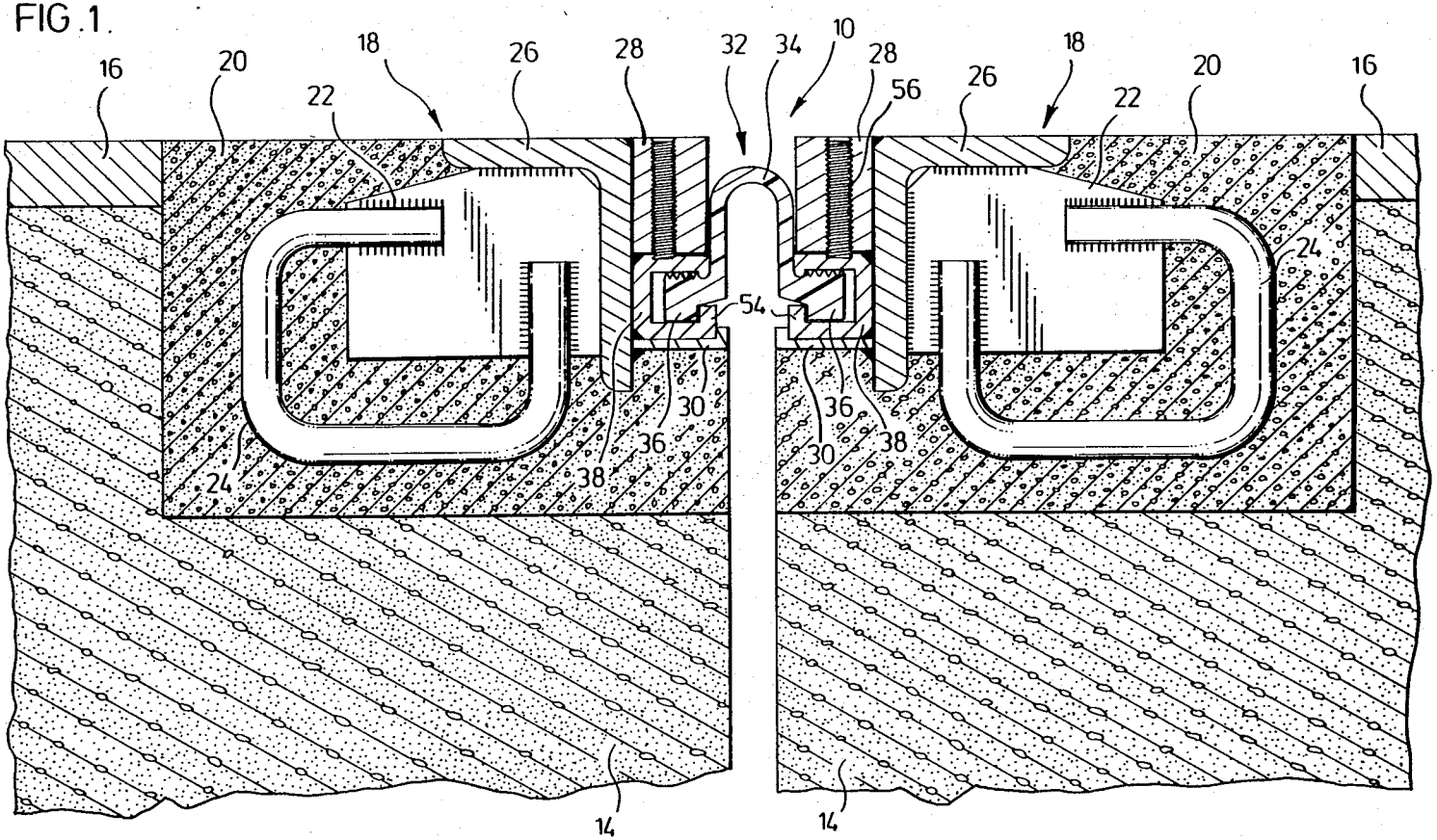
FIG. 1 is a side sectional view of a first embodiment of the expansion joint of the present invention.

The joint 10 comprises at least one seal support assembly 18 adapted to be secured to each section 14. As shown in FIG. 1, each assembly 18 is secured in concrete 20 to the concrete slab 14. To facilitate the securement of the assembly 18 to the concrete slab 14, the assembly includes anchor plates 22 and iron ring bars 24 welded to forming angle member 26. It should be understood that any suitable anchorage such as reinforcing bars, studs or flat bars welded to the angle 26 may be employed. The angle 26 has welded thereto an upper elongate portion 28, comprising a beam, and a lower forming portion 30, comprising a plate or bar. As shown, the lower forming plate 30 provides a form limiting placement of the concrete below the joint 10. As shown in FIG. 1, the opposing assemblies 18 define a gap 12 between assemblies 18. When each assembly 18 is secured to slab 14, upper beam portion 28 and lower forming plate portion 30 are located adjacent gap 12.

A sealing means or element 32 spans the gap 12 between the assemblies 18. Sealing element 32 has an intermediate flexible portion 34 extending between two elongate flanks 36.

The joint 10 further includes a clamping means or clamping member 38. In the embodiment shown in FIGS. 1 to 4, the clamping member 38 is elongate and is insertable into channel 40. Channel 40 is defined by the upper beam portion 28, the lower forming plate portion 30, wall 42 of the angle 26 defines the channel rear wall. Channel 40 may extend vertically when it forms part of a side wall of a bridge or the like. The channel 40 has a mouth 44 which opens toward the gap 12. The upper beam portion 28 and lower plate portion 30 are welded to angle 26 and, accordingly, are fixed relative to each other.

The clamping member 38 includes a rear wall 48, and an upper jaw 50 and a lower jaw 52. Upper and lower jaws 50 and 52 normally diverge. The lower jaw 52 is substantially normal to the rear wall 48 while the upper jaw 50 extends upwardly at an angle to the rear wall 48. The clamp 38 is made of an elastic and resilient material which is compressed when inserted into slot 40. In the embodiment shown, the clamping member 38 is of a shape which is substantially complementary to the shape of the slot 40 when the clamping member 38 is inserted into slot 40. During assembly, the flank 36 is inserted into the clamping member 38. The clamping member 38 embraces the flank 36 in engaging relation when inserted in slot 40.

The lower forming plate 30 may have an upstanding flange 54 which acts as a locking means to restrain clamp 38 from moving out of slot 40. The upper beam portion 28 is provided with a threaded aperture 56 in which a locking bolt 58 threadably engages the aperture. Bolt 58 is rotated to engage the upper jaw 50 of clamping member 38. The upper jaw 50 of clamp 38 is provided with a groove 60 which receives bolt 58. Further, the clamp 38 has a ridge 62 at the end of the upper jaw 50 remote of rear wall 48. When the bolt 58 is rotated and brought into engagement with groove 60, clamp 38 compresses such that flange 52 and ridge 62 prevent the removal of the flank 36 from the clamp 38. The bolt 58 and locking bar flange 54 prevent the removal of the clamp from the slot 40. The bolt 58 and flange 54 have been referred to elsewhere in the specification as respective seal locking means.

Because the jaws 50 and 52 of the clamp 38 diverge, when the clamp 38 is inserted into the channel 40 there is a tolerance fit between the two. The beam portion locking means or bolt 58 provides a press fit for the clamping member 38 in slot 40. Also, the resilience of the diverging jaws of the clamp 38 provide a press fit for the clamp 38 in channel 40. As shown in the embodiments of FIGS. 1 through 4, the flank 36 does not completely fill the space provided within the clamping member 38. It is not necessary that flank 36 fill this space as long as clamp 38 lockingly engages flank 36 when the clamp 38 is compressed. Further, the bolts 58 are provided with recessed hex head 64 into which plastic caps may be inserted to maintain the recess 64 free of debris.

Figure 5:
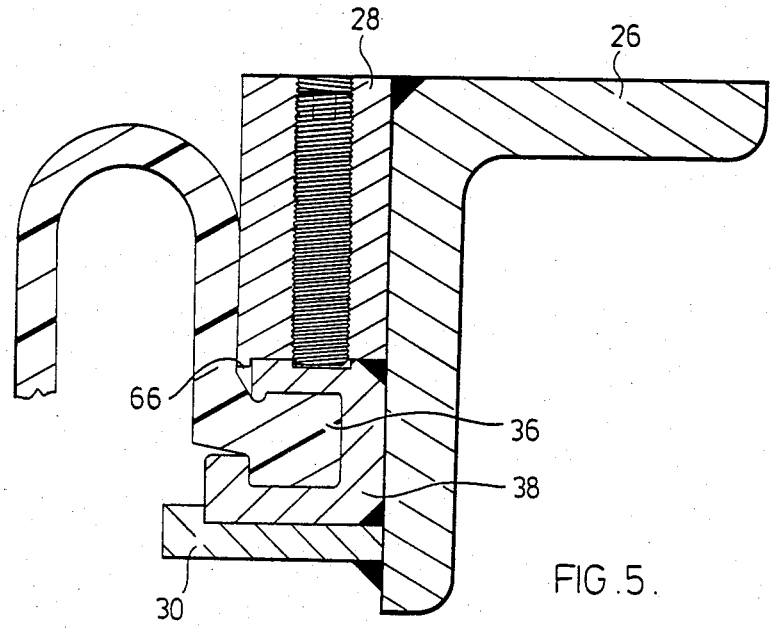

Referring now to FIG. 5 an alternate embodiment is shown. The difference between the embodiment of FIG. 5 and that shown previously is that the flank 36 completely fills the space within the clamp 38. Further, the upper beam portion 28 is provided with a downwardly depending lip portion 66 which lockingly engages and abuts the end of the upper jaw 50 of clamp 38 when the clamp 38 is inserted into channel 40.

Figure 6:
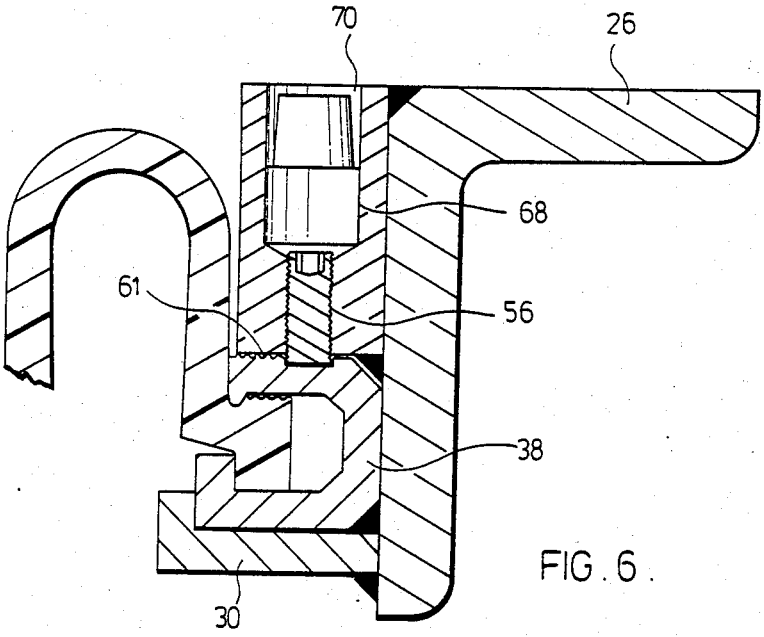

Referring to FIG. 6 in this embodiment the threaded aperture 56 has a bore 68 located above aperture 56. A plastic cap 70 is inserted into bore 68 to provide a cover preventing debris from filling the bore 68 and making access to bolt 58 harder. While this embodiment shows a bore 68, this usually involves an additional manufacturing step which usually adds expense to the manufacture of the assembly. Also, the upper jaw of clamp 38 is provided with a series of elongate ribs 61 which engage upper beam portion 28. Ribs 61 grip beam portion 28 and inhibit water seeping into slot 40.

Figure 7:
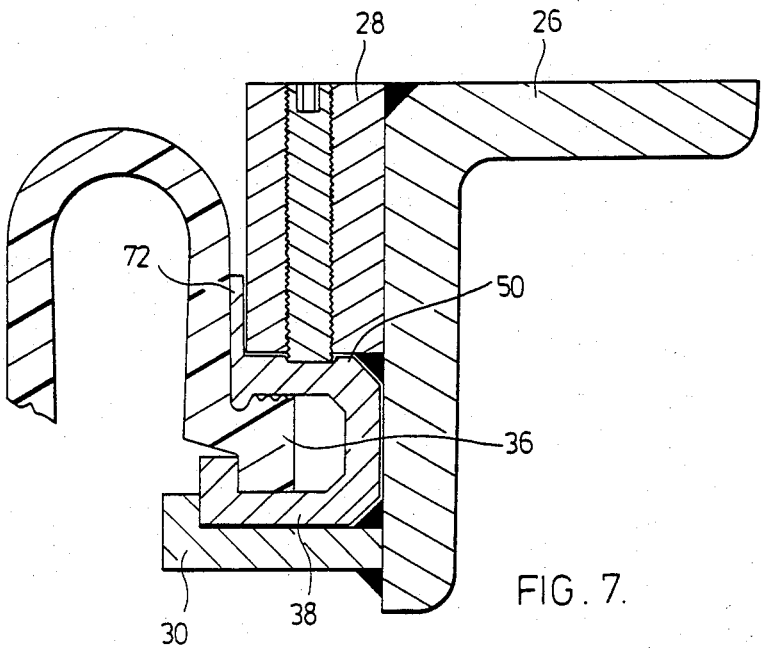

Referring now to FIG. 7, this embodiment shows the addition of a flange 72 upstanding from the upper wall 50 of the clamp 38. The flange 72 abuts a portion of the beam portion 28. The purpose of flange 72 is to facilitate removal of the clamp 38 from slot 40.

Figure 8:
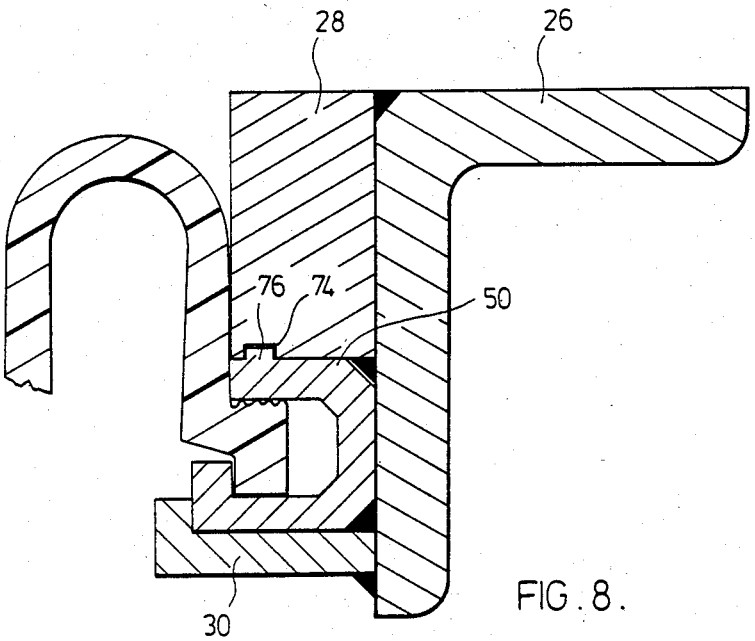

Referring to FIG. 8, there is shown an alternate embodiment wherein the locking means of the upper beam portion 28 comprises a grooved recess 74. The upper wall of the clamp 38 includes a rib 76 matingly engaging the groove 74. In this embodiment, the clamp 38 is held in place through means of its tolerance fit and the tendency of the upper wall 50 to assume its normal position.

Referring to FIG. 9, there is shown an alternate embodiment wherein the clamping means comprises an elongate flexible member 78 having a major portion 80 which rests on top of the flank 36. The bolts 58 may be rotated to compress portion 80 of member 78 against flank 36 and the lower locking and forming plate 30.

Referring to FIG. 10 there is shown a similar embodiment wherein the clamp member 78 includes two depending portions 82 which partially embrace the flank 36. The member 78 is provided with an upper U-shaped member 84 into which the bolt 58 is received.

In FIG. 11 a further alternative embodiment of the present invention is illustrated. In this embodiment the corresponding parts are correspondingly numbered. When compared to the embodiment illustrated in FIG. 3, the embodiment of FIG. 11 does not have the flange 54 and the clamp 38 is provided with a finger 100 upwardly extending from the top wall thereof in the manner shown to provide orienting, seating and securing of the clamp 38. Further securement of the clamp 38 is effected by the bolt and nut 102 and 103 which extends through angle 26 and clamp 38 in the manner shown.

The clamp 38 in FIG. 11 comprises, in the normal open position, a body with upper and lower jaws 50, 52. As shown in the left-hand side of the section, upper jaw 50 and lower jaw 52 in the normal open position, define a mouth which receives the adjacent flank 36. In this embodiment clamp 38 is of polyurethane, or a combination of chloroprene and rubber or any elastomeric or plastic of sufficient hardness and flexibility. A hardness of 40 D has been found suitable. To mount clamp 38 in the channel 40 it is merely inserted so that the finger 100 and the lower corner are matingly seated against wall 42 with the corresponding holes in the rear wall 42 and angle 26 aligned and then bolt and nut 102 and 103, are secured. By this arrangement the clamp 38 is seated and secured in a substantially water-right relationship with the angle 26.

In all the embodiments shown, in order for water to travel between the seal and into the gap 12, it is necessary for the water to flow around the joint provided between the compressible clamp 38, 78 and the outside wall of the slot 40. In the embodiments shown in FIGS. 9 and 10 the water must travel in part between the flank 36 and wall or lower clamping plate 30. Due to the pressure of the fit and the compression of the seal it is not likely that water can travel around this path.

It should further be understood that in the embodiment shown in FIG. 7 where the clamp has an upstanding flange 72, it will be extremely difficult for water to percolate between the clamping member and the beam portion and rust bolt 58. While some water may be able to seep into this area it is not considered to be significant to damage the bolt in any significant way as the forward portion of the bolt does not necessarily have to be threaded.

As shown in the drawings, the assembly of the sealing element 34 may be readily made. It should be understood that the distance between the gap 12 may be in the order of one and one half to two and one half inches and that the sealing element may be in lengths of several feet. The assembly 18 is delivered to the job site preassembled. Once the assembly 18 has been secured in the concrete 20 at the job site, the flank 36 of the seal element 34 is inserted into the clamping means. The clamp and flank are then inserted together into the slot 40. To allow for insertion of the flank and clamp into slot 40, the distance across the mouth opening of the mouth 40 must be equal or greater than the height of the rear wall 48 of clamp 38 or a combination of the flank 36 and clamping means 78 shown in FIGS. 9 and 10. It should be understood that the diverging jaws of clamp 38 are greater in width than the mouth of the slot so as to allow the clamp 38 to be compressed into engagement with the slot once it is inserted therein.

What is claimed is:

1. An expansion joint for providing a flexible seal between two spaced-apart confronting sections of similar structures such as roadway slabs or the like, said joint comprising:

at least one seal support assembly secured to each section to define a gap between opposed seal support assemblies, each said assembly including spaced apart upper and lower elongate members defining opposed channels and clamping means seated within the channels;

sealing means for spanning the gap between opposed assemblies, said sealing means including an intermediate portion and laterally extending flanks one on each side of said intermediate portion;

said clamping means including an upper jaw and a lower jaw, said upper jaw being movable into locking engagement with an adjacent flank to compressibly retain said flank in said channel; and means positioned substantially directly above each flank and in contact with the upper jaw of the respective clamping means for urging said upper jaw into engagement with said flank.

2. An expansion joint as claimed in claim 1 wherein said upper and lower jaw of said clamping means are formed integrally.

3. An expansion joint as claimed in claim 2 wherein said clamping means is made of a material chosen from the group consisting of a compressible elastomer and a polymer.

* * * * *